US006036663A

United States Patent [19]

Arzt

[11] Patent Number: 6,036,663

[45] Date of Patent: Mar. 14, 2000

[54] HYDRO-MASSAGE CHAIR

[76] Inventor: Frank J. Arzt, Alfred H. Koch Services Laboratory 1614 McDade Blvd., Folsom, Pa. 19033

[21] Appl. No.: 09/119,056

[22] Filed: Jul. 20, 1998

[51] Int. Cl.[7] ..... A61H 9/00

[52] U.S. Cl. ..... 601/156; 601/158; 601/148

[58] Field of Search ..... 601/49, 55, 61, 601/86, 88, 148, 149, 150, 152, 157, 158, 159, 160; 297/180.1, 180.15, DIG. 8

[56] References Cited

U.S. PATENT DOCUMENTS

| | | | |
|---|---|---|---|
| 4,258,706 | 3/1981 | Shank | 128/33 |
| 4,635,620 | 1/1987 | Ricchio | 128/64 |
| 4,738,486 | 4/1988 | Surber | 297/284 |
| 4,839,930 | 6/1989 | Watkins | 4/546 |
| 5,354,117 | 10/1994 | Danielson et al. | 297/180.15 |
| 5,827,206 | 10/1998 | Lunter | 601/148 |

*Primary Examiner*—Danton D. DeMille
*Assistant Examiner*—Tam Nguyen
*Attorney, Agent, or Firm*—William Freedman

[57] ABSTRACT

This hydro-massage chair comprises horizontally-spaced sidewalls, a seat portion extending between the sidewalls, and an inclined back portion adapted to support the back of a patient seated on the seat portion. An inflatable hollow cushion has a back wall bearing against the inclined back portion and a soft front wall facing the back of the seated patient. The cushion is inflated by introducing liquid into its interior. Nozzles are mounted in spaced relation along the length of the cushion for injecting pressurized liquid jets into the interior of the cushion and against the inside of the front wall of the cushion to produce a massaging effect on the back of the seated patient. A plurality of bars spaced apart along the length of the cushion extend between the sidewalls and confine the front wall of the inflated cushion but allow the front wall to bulge slightly in the regions between the bars when the cushion is inflated with liquid.

6 Claims, 5 Drawing Sheets

HYDRO-MASSAGE CHAIR

FIELD OF THE INVENTION

This invention relates to a hydro-massage chair and, more particularly, to a chair of this type that comprises an inflatable, liquid-filled cushion that bears against the back of the chair and includes spaced-apart nozzles through which jets of pressurized liquid are injected into the interior of the liquid-filled cushion to produce a massaging effect on a patient seated in the chair.

BACKGROUND

U.S. Pat. No. 4,635,620—Ricchio discloses a hydro-massage bed that includes a horizontally-oriented inflatable liquid-filled cushion that includes spaced-apart nozzles through which jets of pressurized liquid or a liquid and air mixture are injected into the interior of the cushion to produce the desired massaging effect. This prior art bed is well adapted to providing the desired massage to patients while they are in a prone position, but many patients prefer to be treated while in a seated position.

To construct a chair that allows for the desired treatment of a seated patient, it is necessary to orient the inflatable liquid-filled cushion in a non-horizontal position, preferably, in an inclined position approaching the vertical. But if the cushion is so inclined and is inflated with liquid, a special problem occurs. More specifically, the cushion tends to develop a large bulge in the region that the lower back of the patient would normally rest against. This large bulge can be quite uncomfortable to the seated patient and will interfere with effective transfer of the jet action to the back of the patient. This large bulge results from the weight of the liquid in the inclined cushion and the confinement of the cushion in its lower region beneath the bulge.

OBJECTS

An object of my invention is to construct the hydro-massage chair in such a manner that this large bulge in the inclined cushion adjacent the lower back of a seated patient is not present to cause discomfort to the seated patient or to interfere with effective jet action against the back of the seated patient.

Another object is to construct the hydro-massage chair in such a manner that the above-described large bulge in the inclined cushion is substantially eliminated, yet without interfering with the ability of the above-described jets to produce the desired massaging effect against the back of the seated patient.

Another object is to construct the hydro-massage chair in such a manner that the upper portion of the liquid-filled cushion wraps partially around the neck of the seated patient so as to provide more effective massage and comfort during treatment.

SUMMARY

In carrying out the invention in one form, I provide a chair that comprises a pair of horizontally-spaced sidewalls, a seat portion extending between the sidewalls, and an inclined back portion extending between the sidewalls and adapted to support the back of a patient seated on the seat portion. An inflatable hollow cushion has a back wall bearing against the inclined back portion of the chair and a soft front wall facing the back of the seated patient. The cushion is inflated by the introduction of liquid into its interior. A plurality of nozzles are mounted in spaced relationship along the length of the cushion and are adapted to inject pressurized liquid jets into the interior of the inflated cushion and against the inside of the front wall of the cushion. Means is provided for supplying pressurized liquid to the nozzles to produce the jets and a resulting massaging effect on the portion of the seated patient bearing against the front wall of the cushion. A plurality of bars spaced apart along the length of the cushion extend between the sidewalls and confine the front wall of the inflated cushion but allow the front wall to bulge slightly in the regions between the bars when the cushion is inflated with liquid.

Located above the top one of the bars and spaced from it, there is a plate (referred to as a push plate) against which the upper portion of the cushion presses when inflated. Inflation with liquid of the cushion against the push plate causes the cushion to develop in the region between the top bar and the push plate a soft liquid-filled bulge that overlaps the top bar and is capable of partially surrounding the neck of a seated patient when his neck rests against the soft bulge.

BRIEF DESCRIPTION OF DRAWINGS

For a better understanding of the invention, reference may be had to the following detailed description taken in connection with the accompanying drawings in which.

DETAILED DESCRIPTION OF EMBODIMENT

Figure 1:
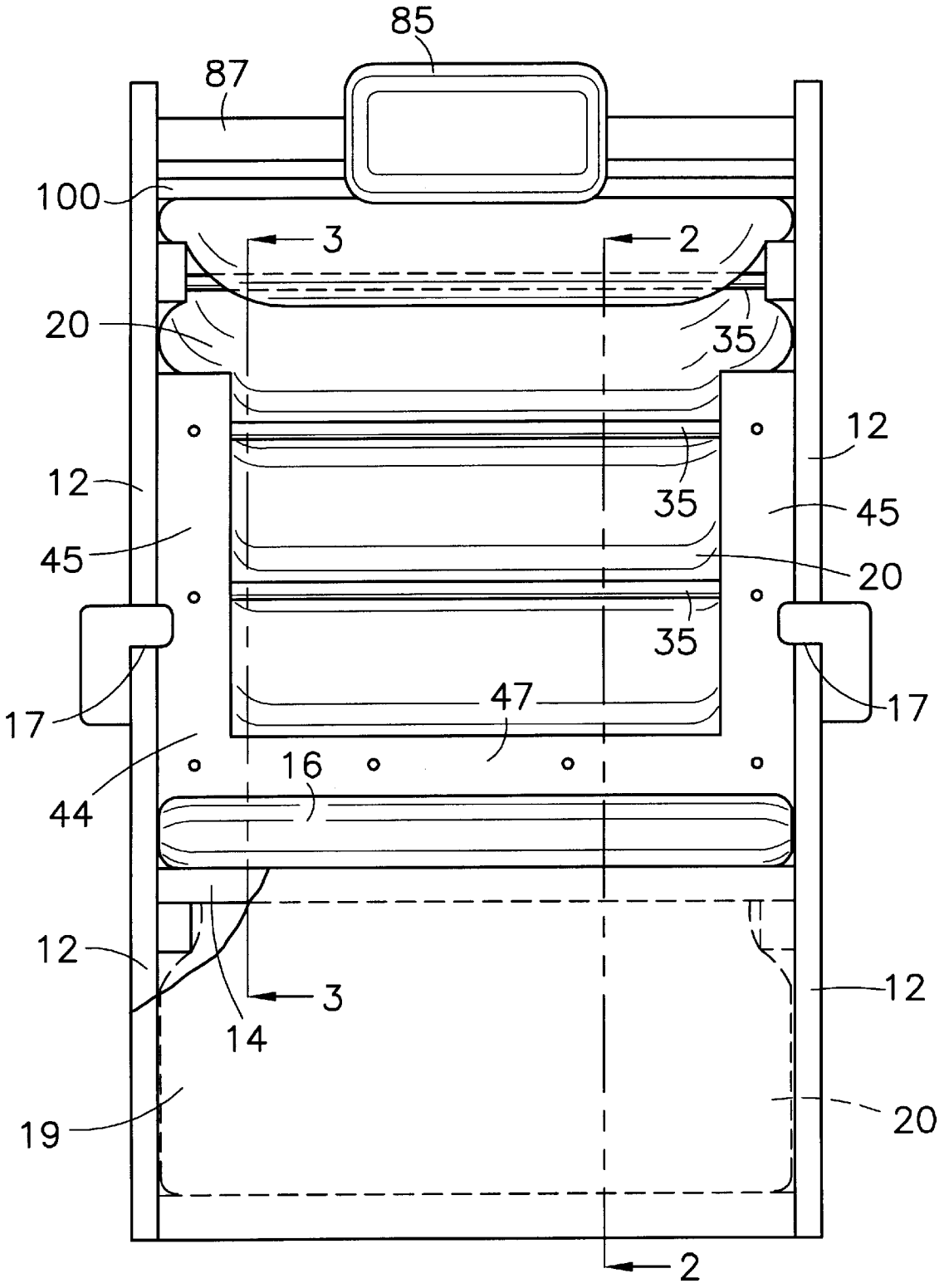
FIG. 1 is a front view of a hydro-massage chair embodying one form of my invention and including an inflatable liquid-filled cushion.

Referring first to FIG. 1, the hydro-massage chair 10 comprises a pair of horizontally-spaced rigid sidewalls 12 and a rigid seat portion 14 extending between the sidewalls 12 and adapted to support the rump of a seated patient. Resting upon the seat portion 14 is a soft seat cushion 16. The sidewalls 12 are shaped to provide arm rests 17 for the seated patient. A vertically-extending cover 19 is fixed to the sidewalls 12 beneath seat portion 14 at the front of the chair.

Figure 2:
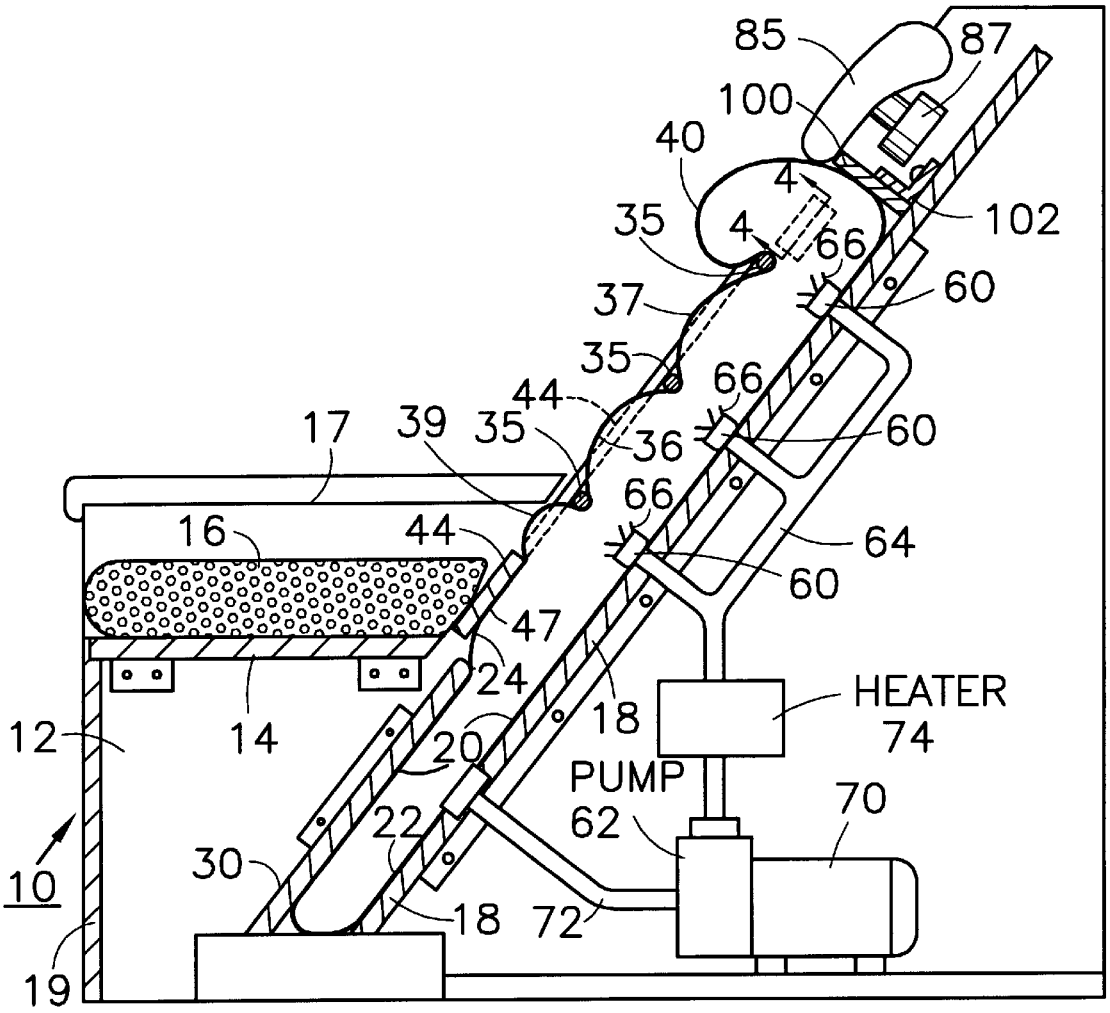
FIG. 2 is a sectional view of the chair of FIG. 1 taken along the line 2—2 of FIG. 1.

Referring to FIG. 2, an inclined back portion 18 extends between the sidewalls 12 from a location near the bottom of the chair to location near the top of the chair. This back portion is suitably fixed to the sidewalls 12. In one embodiment of the invention, the sidewalls 12, the seat portion 14, and the back portion 18 are constructed of a sturdy plywood material.

Positioned against the back portion 18 is an inflatable, hollow cushion 20 that extends from near the bottom of the chair to a location near the top of the chair. The inflatable cushion is preferably made of a flexible vinyl membrane that is impervious to water. The cushion 20 includes a back wall 22 that bears against the inclined back portion 18 of the chair and a front wall 24 that faces the back of a patient who would be seated in the chair. The cushion has a length dimension that extends along the length of the inclined back portion 18 and a width dimension that extends between the sidewalls 12. In the lower region of the cushion 20 below the seat portion 14, there is a rigid panel 30 that extends between the sidewalls 12 and is suitably fixed to the sidewalls. This panel 30 is inclined at the same angle as the back portion 18 and is spaced from the back portion 18. The lower portion of the cushion 20 fits into the space between panel 30 and the back portion 18 and is confined between panel 30 and the back portion 18.

The chair is prepared for operation by filling the interior of the cushion 20 with water. This can be done through suitable fill openings (not shown) at the top of the cushion. The water filling the cushion 20 inflates it and forces the front wall 24 in a direction away from the back wall. For controlling the position of the front wall 24 following inflation of the cushion, I provide a plurality of rigid bars, or rods, 35 that are spaced apart along the length of the cushion, that extend between the sidewalls 12 and are fixed at their respective opposite ends to the sidewalls. As shown in FIG. 2, the cushion bulges slightly at 36 and 37 in locations between the bars 35 and also at 39 below the bottom bar. Above the top bar there is a more pronounced bulge at 40.

Figure 3:
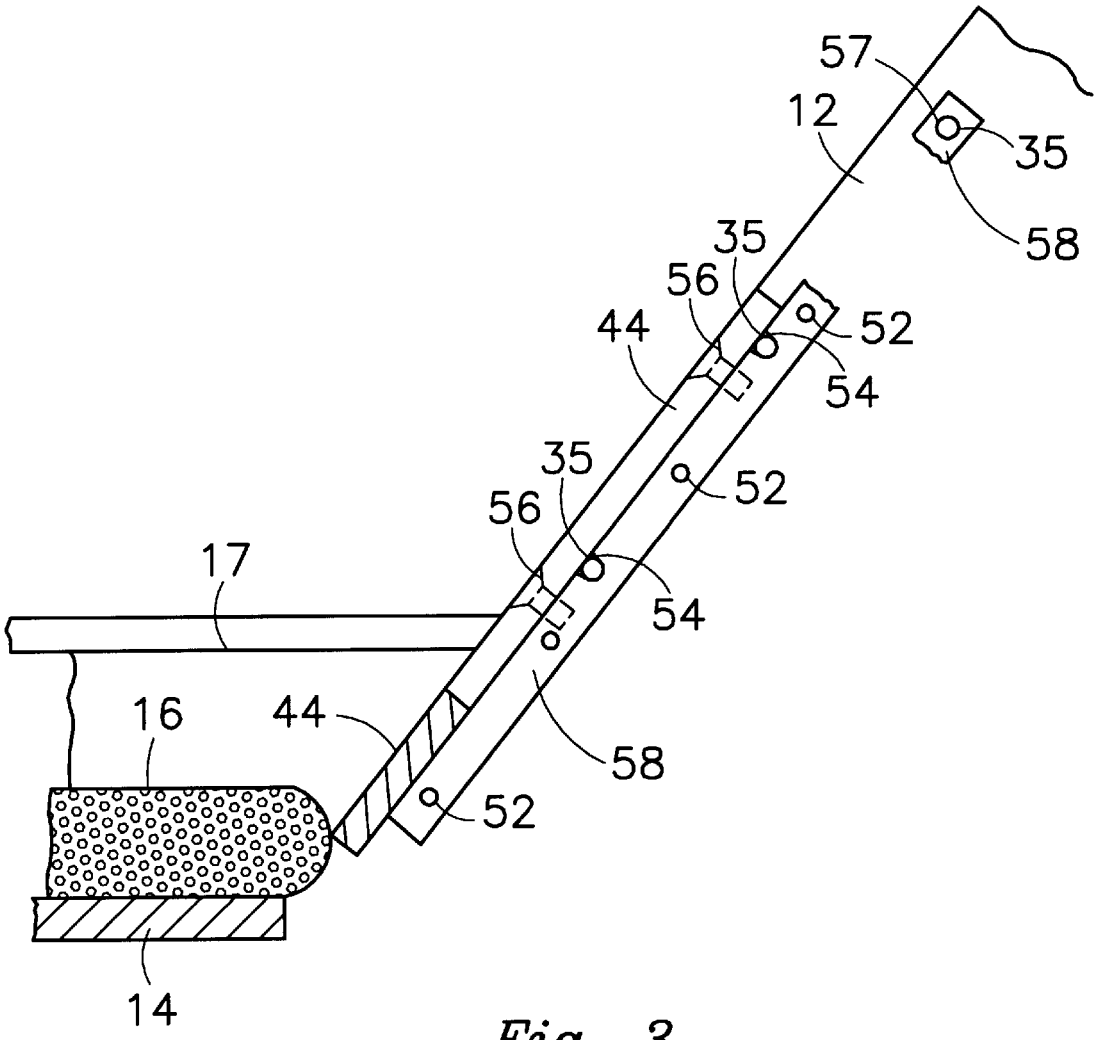
FIG. 3 is a sectional view taken along the line 3—3 of FIG. 1 but, for simplification, omitting the cushion that is depicted in the view of FIGS. 1 and 2.

Referring to FIG. 1, for confining the cushion 20 at its lateral edges, a U-shaped frame 44 is provided. This frame 44, which can be of plywood, is suitably fixed to the sidewalls 12. The U-shaped frame 44 comprises legs 45 of plate form respectively located adjacent the sidewalls 12 and a bottom portion 47 of plate form extending between the legs 45 adjacent the seat portion 14 of the chair. FIG. 3 shows a preferred arrangement for fixing the frame 44 and one end of the bars 35 to the sidewalls 12. In this arrangement an elongated support member 50 is fixed to one sidewall by screws 52. This support member has suitably-located notches 54 on its front face for receiving the bars 35. The U-shaped frame 44 bears against the front face of the support member 50, and screws 56 extending through the frame into the support member secure the frame in this position. The frame 44 also holds the bars 35 in their notches 54. A similar supporting arrangement is provided on the opposite sidewall 12 for supporting the other leg 45 of the frame 44 and the opposite ends of bars 35.

The upper bar 35 is secured to the sidewall 12 by having one end positioned within a mating hole 57 in a block 58 attached to the sidewall 12. A similar block with mating hole is provided on the other sidewall 12 for securing the opposite end of the upper rod 35 to the other sidewall.

Referring to FIG. 2, for massaging the back of a patient seated in the chair 10, a plurality of nozzles 60 spaced apart along the length of the cushion 20 are provided. Pressurized liquid is supplied to these nozzles 60 by a motor-driven recirculating pump 62 connected to the nozzles by suitable piping 64, thereby producing jets 66 issuing from the nozzles. The nozzles 60 direct the jets 66 through the liquid within the hollow cushion and against the front wall 24 of the cushion. These jets produce a pleasurable massaging effect on the back of a patient seated in the chair. The nozzles 60 are mounted in the back wall 22 of the cushion 20 in a suitable conventional manner.

To enhance the massaging effect of the jets, each nozzle is provided with a rotor (not shown) that is mounted for rotation within the central passageway of the nozzle. When pressurized liquid is supplied through this central passageway, it causes rotation of the rotor, and this results in the jet rotating about the central axis of the rotor. Nozzles with such rotors are conventional and can be purchased from spa equipment suppliers. Rotation of the jet disperses the massaging effect of the jet over a larger area, and this enhances its effectiveness.

In one embodiment of the invention, I locate the nozzles so that the areas covered by adjacent jets overlap, and this overlapping enhances the massaging effect of the jets while they are simultaneously in operation.

The recirculating pump 62 is driven by a suitably-controlled electric motor 70. The pump has an inlet 72 which is connected to the interior of the cushion 20 near the bottom of the cushion. Operation of the pump draws liquid from the cushion, pressurizes the liquid, and supplies it to the nozzles 60 to produce the jets 66. Located between the pump 62 and the nozzles 60 is a conventional thermostatically-controlled heater (shown diagrammatically at 74) that heats the water to an appropriate temperature for the patient's comfort before it enters the nozzles 60.

The above-described heating is usually effected as part of a start-up operation that prepares the chair for patient use. After a short period, some cooling of the liquid may be needed to maintain its temperature at the desired level. A suitable cooler (not shown) connected into the liquid circuit and automatically operated when needed is provided for this purpose.

Figure 4:
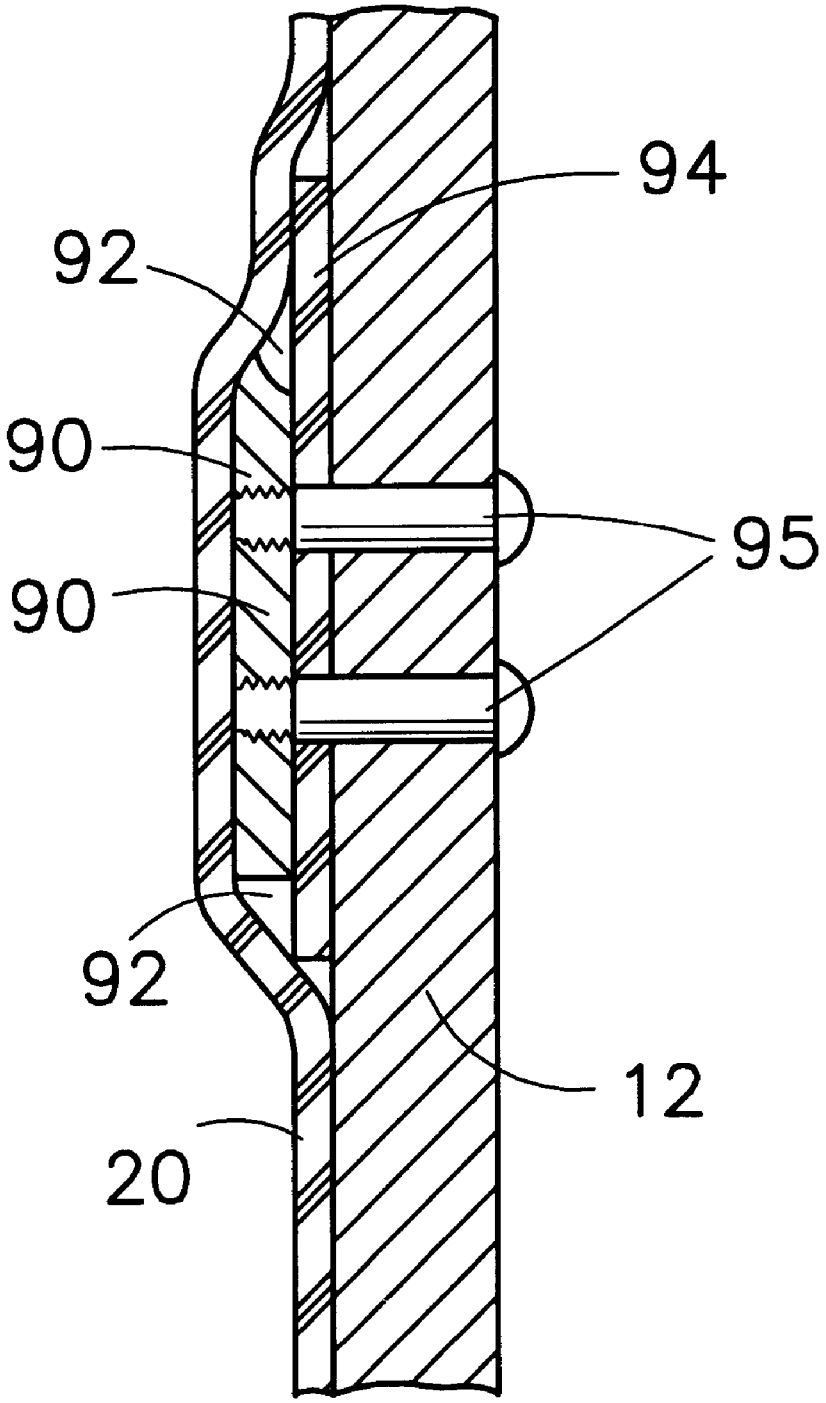
FIG. 4 is an enlarged sectional view taken along the line 4—4 of FIG. 2
Figure 5:
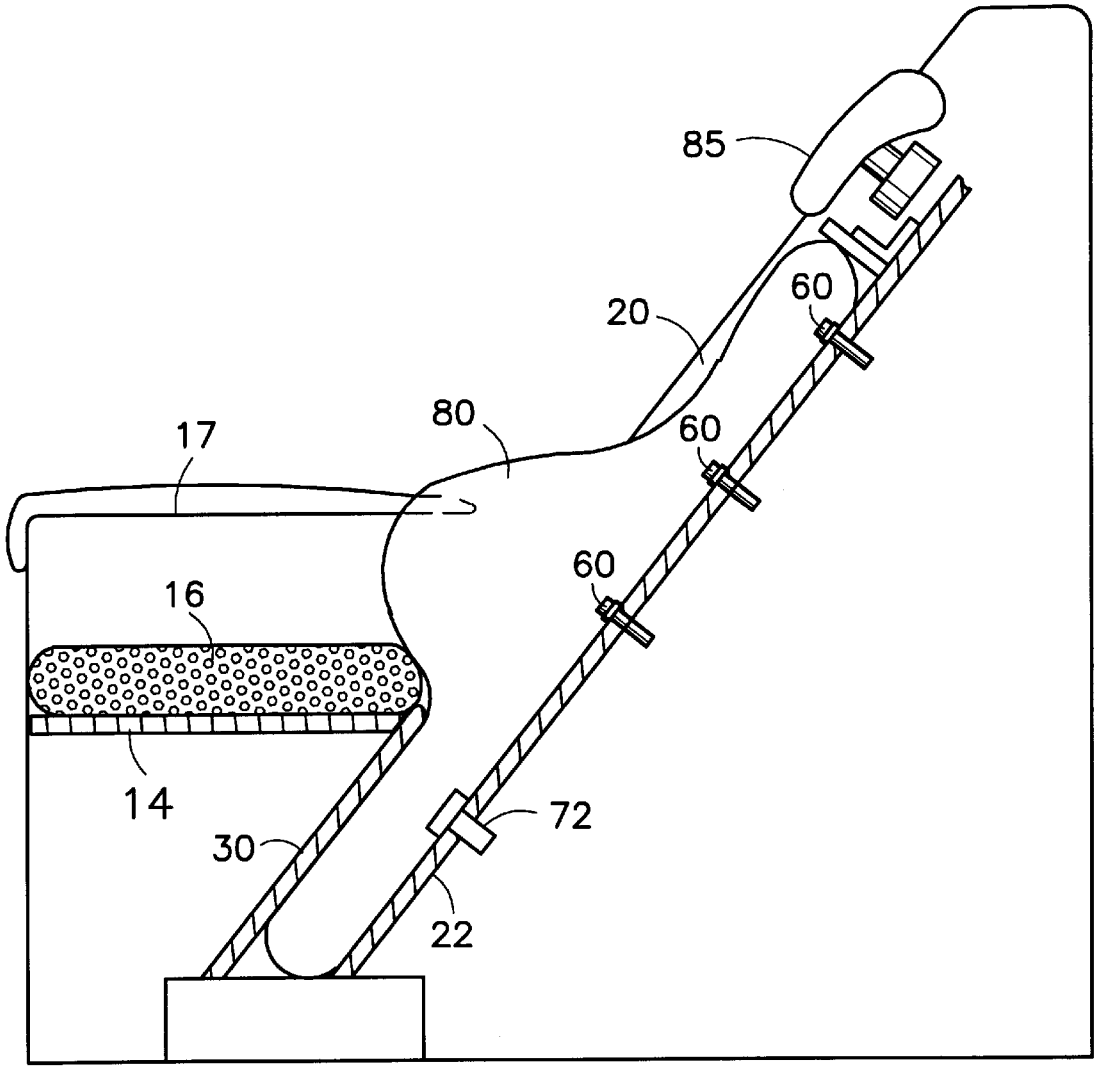
FIG. 5 is a sectional view in simplified form similar to FIG. 2 except depicting the chair without the bars 35 and the frame 44 of FIG. 1 and 2, which have been omitted to illustrate the large bulge problem referred to hereinabove.

A problem that was encountered in the development of this hydro-massage chair is illustrated in FIG. 5, which shows in simplified form a chair corresponding to that of FIGS. 1–4 but without the bars 35 and the frame 44 of the chair of FIGS. 1–4. When the cushion 20 of the FIG. 5 chair was filled with water, a large bulge 80 developed in the region just above the seat portion 14 of the chair. This bulge proved to be an annoying source of discomfort to patients seated in the chair and also prevented seated patients from leaning back into a position of full contact with the cushion to allow for a full spinal massage by the jets. Before I introduced the bars 35 into the chair construction, I made various attempts to reduce the size of this bulge, but these were found to be ineffective or had other disadvantages. For example, a plastic gridwork stretched tightly over the bulge region before inflation of the cushion was found to be hard and uncomfortable to patients; and a cloth barrier placed over the bulge region was found to have insufficient strength to restrain the bulge from forming. Reinforcement placed inside the cushion typically has the disadvantage of interfering with one or more of the jets 66. The use of the spaced-apart bars 35 proved to be a simple and effective way of preventing this large bulge from developing and yet, being external to the cushion 20, did not interfere with the jets 66. The presence of the U-shaped frame 44 imparted further restraint to the cushion in the bulge region, especially in the locations near the sidewalls 12 and seat portion 14 of the chair.

For anchoring the cushion 20 against downward shifting, there is provided on each sidewall 12 a tab 90 that is fixed to the sidewall 12 and fits into a pocket 92 provided on the side of the cushion 20. FIG. 4 is an enlarged sectional view along the line 4—4 of FIG. 2 showing one of these tabs 90 and a pocket 92 receiving the tab. One wall of the pocket 92 is formed by a rectangular flap 94 of the same vinyl material as the cushion bonded to the exterior of the cushion around three of the four edges of the flap. The tab 90 is fixed to the sidewall 12 by screws 95 extending through the flap 94 and into the tab.

The hydro-massage chair has a padded head rest 85 for the seated patient located near the top of the cushion 20. The head rest is mounted on a cross-beam 87 that extends between the sidewalls 12 and is fixed at its opposite ends to the sidewalls. The presence of the cross-beam imparts added mechanical strength to the chair.

Another feature of the hydro-massage chair is the character of the top bulge 40 of the cushion 20, especially its ability to wrap partially around the neck of a seated patient when the patient leans against the back of the chair. When the cushion 20 is being filled with liquid, near the end of the filling operation the top of the cushion pushes against a plate 100 that is located adjacent the top of the cushion and is fixed to the back portion 18 of the chair. Since the upper region of the cushion is anchored against downward shifting by the tabs 90 of the FIGS. 2 and 4, continued filling of the cushion causes the bulge 40 to enlarge in a forward direction until it finally develops into the shape shown in FIG. 2, at which time the filling operation is discontinued. This bulge is relatively soft and is able to yield to the pressure of a seated patient's neck resting against it, thus wrapping partially around the patient's neck. This partial wrapping provides more comfort to the seated patient and contributes to more effective massage.

The plate 100, which is referred to herein as a push plate, is secured to the back portion 18 of the chair by L-shaped metal brackets 102 attached by screws to the back portion 18 and the push plate, as is shown in FIG. 2.

While a particular embodiment of the invention has been shown and described, it will be apparent to those skilled in the art that various changes and modifications may be made without departing from the invention in its broader aspects; and it is therefore intended herein to cover all such changes and modifications as fall within the true spirit and scope of the invention.

What is claimed as new is:

1. A hydro-massage chair comprising:

(a) a pair of horizontally-spaced generally-vertical sidewalls, (b) a seat portion extending between said sidewalls and adapted to support the rump of a seated patient, (c) an inclined back portion extending between said sidewalls and adapted to support the back of a seated patient, (d) an inflatable cushion having a back wall bearing against said inclined back portion and a front wall facing the back of said seated patient, the cushion having a length dimension that extends along said inclined back portion and a width dimension that extends between said sidewalls, the cushion being inflated by the introduction of liquid into its interior, (e) a plurality of nozzles spaced apart along the length of said cushion for injecting pressurized liquid jets into the interior of said cushion and against the inside of the front wall of said cushion, (f) means for supplying pressurized liquid to said nozzles to produce said jets and a massaging effect on the portion of the seated patient bearing against the front wall of said cushion, and (g) a plurality of spaced-apart bars extending between said sidewalls, fixed to said sidewalls, and confining the front wall of the inflated cushion but allowing the front wall to bulge slightly in the regions between said bars when the cushion is inflated.

2. A hydro-massage chair as defined in claim 1 and further comprising plates fixed to said chair sidewalls and located adjacent said chair sidewalls in the region of said seat portion for blocking bulging in a forward direction of said inflated cushion in the regions adjacent said sidewalls and said seat portion.

3. A hydro-massage chair as defined in claim 1 and further comprising a U-shaped frame having legs of plate form located adjacent said chair sidewalls and a bottom of plate form located adjacent said seat portion, the frame being fixed to said chair sidewalls and located to block bulging in a forward direction of said inflated cushion in the regions adjacent said sidewalls and said seat portion.

4. A hydro-massage chair as defined in claim 2 in which adjacent each sidewall and fixed to the sidewall there is support structure that includes notches in its front face that receive the ends of said bars, and said plates are respectively attached to said support structures to hold the ends of the bars in said notches.

5. A hydro-massage chair as defined in claim 1 and further comprising push plate structure against which the top of said cushion bears when the cushion is filled with liquid, the cushion expanding in a forward direction when bearing against said push plate structure while being filled, thereby developing a bulge adjacent the top one of said bars that extends forwardly beyond said top bar.

6. A hydro-massage chair as defined in claim 5 and further comprising means for fixing said cushion to said sidewalls at location adjacent the top of said cushion.

* * * * *